US006901707B2

(12) United States Patent
Smerud

(10) Patent No.: US 6,901,707 B2
(45) **Date of Patent: *Jun. 7, 2005**

(54) ARCHED JAMB MEMBER AND METHOD OF SHIPPING AND INSTALLING SAME

(76) Inventor: Richard J. Smerud, 3667 Camino Marglesa, Escondido, CA (US) 92065

( * ) Notice: Subject to any disclaimer, the term of this patent is extended or adjusted under 35 U.S.C. 154(b) by 0 days.

This patent is subject to a terminal disclaimer.

(21) Appl. No.: 10/187,131

(22) Filed: Jun. 28, 2002

(65) Prior Publication Data

US 2004/0000102 A1 Jan. 1, 2004

(51) Int. Cl.[7] ..... E06B 1/24

(52) U.S. Cl. ..... 52/85; 52/86; 52/204.53; 52/211; 52/213

(58) Field of Search ..... 414/11, 801, 802, 414/907; 52/85, 86, 88, 717.01, 707.03, 745.15, 211

(56) References Cited

U.S. PATENT DOCUMENTS

| | | | | |
|---|---|---|---|---|
| 1,149,965 A | | 8/1915 | Stokes | |
| 1,346,161 A | | 7/1920 | Basquin | |
| 2,642,162 A | | 6/1953 | Tobias | |
| 3,008,273 A | | 11/1961 | Widin | |
| 3,159,251 A | * | 12/1964 | Becker | |
| 4,379,376 A | * | 4/1983 | Adell | 49/462 |
| 4,676,045 A | | 6/1987 | Ellen | |
| 4,955,168 A | * | 9/1990 | Barry | 52/210 |
| 5,232,762 A | | 8/1993 | Ruby | |
| 5,417,027 A | | 5/1995 | Wagenet | |
| 5,572,834 A | * | 11/1996 | Lilly | 52/85 |
| 5,584,148 A | * | 12/1996 | Barry et al. | 52/86 |
| 5,618,601 A | | 4/1997 | Ruby | |
| 5,671,583 A | | 9/1997 | Turner | |
| 5,699,638 A | | 12/1997 | Maylon | |
| 5,824,382 A | | 10/1998 | Ruby | |
| 6,128,864 A | * | 10/2000 | Barry et al. | 52/86 |
| 6,401,405 B1 | * | 6/2002 | Hicks | 52/88 |
| 6,408,576 B1 | * | 6/2002 | Roth | 52/85 |
| 6,647,673 B2 | * | 11/2003 | Smerud | 52/88 |

FOREIGN PATENT DOCUMENTS

JP 04055584 A 2/1992

* cited by examiner

*Primary Examiner*—Brian E. Glessner
*Assistant Examiner*—Yvonne M. Horton
(74) *Attorney, Agent, or Firm*—Gordon & Rees LLP

(57) ABSTRACT

An arched jamb member of elongate, strip-like shape for forming the upper end of an arched wall opening is preformed into an arch of predetermined curvature, and is of sufficient flexibility to enable it to be forced into a flat condition for shipping and storage purposes. Once released from its flat condition, it will automatically spring back into an arched configuration.

11 Claims, 2 Drawing Sheets

ARCHED JAMB MEMBER AND METHOD OF SHIPPING AND INSTALLING SAME

BACKGROUND OF THE INVENTION

The present invention relates generally to an arched jamb member for defining the upper end of an arched wall opening such as a door or window opening.

Arched jamb assemblies provide arched wall openings, such as doorways, in homes and other buildings. Arched jamb assemblies generally cost more than conventional rectangular jamb assemblies, but they dramatically enhance the aesthetic appeal and thus the market value of a home, for example.

Prior art arched jamb assemblies generally have a pair of upright jamb members defining opposite sides of the wall opening and an upper, arched jamb member defining the top of the arched wall opening. The upright jamb members have upper end portions which support the upper arched jamb member at its opposite ends. My co-pending U.S. patent application Ser. No. 09/954,683 filed Sep. 11, 2001 is directed to such an arched jamb assembly in which a standard interface is provided between the respective end of the upper arched jamb member and the upper end portion of the upright jamb member, regardless of the curvature of the upper arched jamb member.

One factor which increases expense of an arched jamb assembly is that the upper arched jamb member cannot be packed flat with the two straight upright members, and must often be shipped and stored separately, in a larger package. Thus, the expense of packing and shipping, and the space required for storage, is relatively high.

SUMMARY OF THE INVENTION

It is an object of the present invention to provide a new and improved upper arched jamb member for an arched jamb assembly.

According to one aspect of the present invention, an arched jamb member is provided, which comprises an elongate strip member having opposite upper and lower faces, opposite side edges, and opposite ends, the strip member being formed into an arch of predetermined curvature, and the strip member being of sufficient flexibility to enable it to be forced into a flat condition for shipping and storage purposes.

In one embodiment of the invention, the strip member is of plastic material pre-formed or molded into an arched shape. The upper face of the strip member may have a plurality of parallel, transverse kerfs across its upper face for providing sufficient flexibility to enable it to be forced into a flat condition. Alternatively, the strip member may be of reduced thickness along at least the majority of its length, such that it is sufficiently flexible in the thinner region to allow it to be forced flat. In another alternative embodiment, the strip member has side stiffener elements engageable in slots along its opposite side edges. When the side stiffener elements are engaged, the strip member is held in its arched condition. When the stiffener elements are released, the strip member is sufficiently flexible to be forced into the flat condition.

When released from the forced flat condition, the arched jamb member will spring back into an arched condition and may be installed in an arched wall opening. Thus, the member is forced flat and placed into a flat container, along with the upright side jambs and casing of an arched jamb assembly. When the container is closed, the arched jamb member will be held in the flat condition. When the container is unpacked, the arched jamb member will be released and will spring back into an arched condition, which can be adjusted as needed to adopt the desired curvature at the top of the door opening.

According to another aspect of the present invention, a method of shipping and installation of an arched jamb member is provided, which comprises the steps of:

providing an elongate strip member which is pre-formed into an arched shape and which is of predetermined flexibility;

forcing the arched strip member into a flat condition;

placing the flattened strip member into a flat packaging container and constraining it in the flat condition in the container;

transporting the flattened strip member in the container to an installation location;

releasing the flattened strip member from the container, whereby it springs back into an arched condition; and installing the jamb member at the top of an arched wall opening.

The arched jamb member of this invention is preformed with the desired arch curvature for the top of an arched wall opening, yet can be shipped readily in a flat condition along with the other, straight components of an arched jamb assembly. The jamb member is designed to have sufficient flexibility to be forced flat, while retaining its memory and springing back into an arched configuration on release, so that it is immediately ready to be installed when unpacked. When installed in the doorway with spacers, the arched jamb will adopt the correct curvature.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which.

DETAILED DESCRIPTION OF THE DRAWINGS

Figure 1:
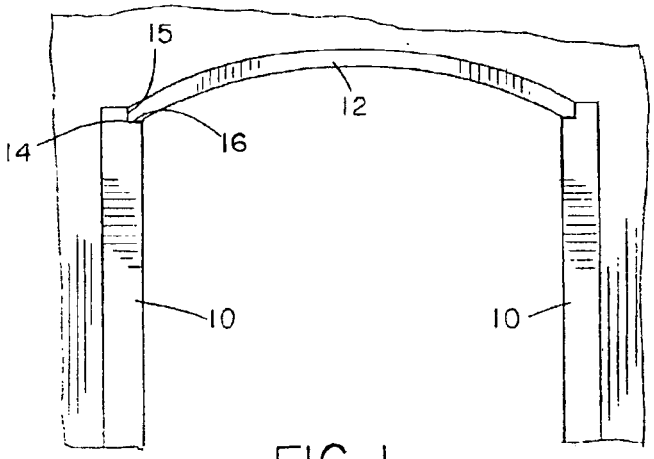
FIG. 1 is a front view of the top portion of a typical door jamb with the arched top installed.

FIG. 1 of the drawings illustrates an arched jamb assembly for forming an arched wall opening, such as a doorway. The assembly illustrated is described in my co-pending application Ser. No. 09/954,683 filed Sep. 11, 2001, the contents of which are incorporated herein by reference. The assembly basically comprises a pair of upright jamb members 10 extending along opposite sides of the opening, and an upper arched jamb member 12 extending between the upper ends of jamb members 10 at the upper end of the arched opening. The arched jamb member 12 is generally of rigid construction, having generally smooth, planar upper and lower faces and is of uniform thickness along its length.

The arched upper jamb member 12 will be of predetermined curvature and radius of curvature, depending on the desired arch shape at the top of the opening. Each upright jamb member 10 has an angled cut-out 14 at its upper end, while the outer ends of the arched jamb member 12 have angled cuts 15, 16 designed for mating engagement in the respective angled cut-outs 14.

Figure 2:
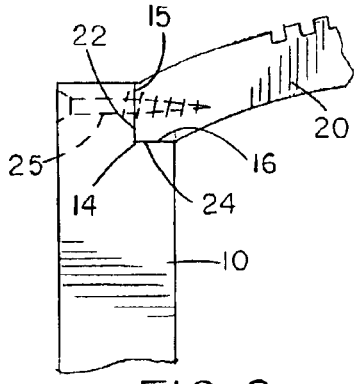
FIG. 2 is an enlargement of one end of an arch attachment using an arched jamb member according to an exemplary embodiment of the invention.
Figure 3:
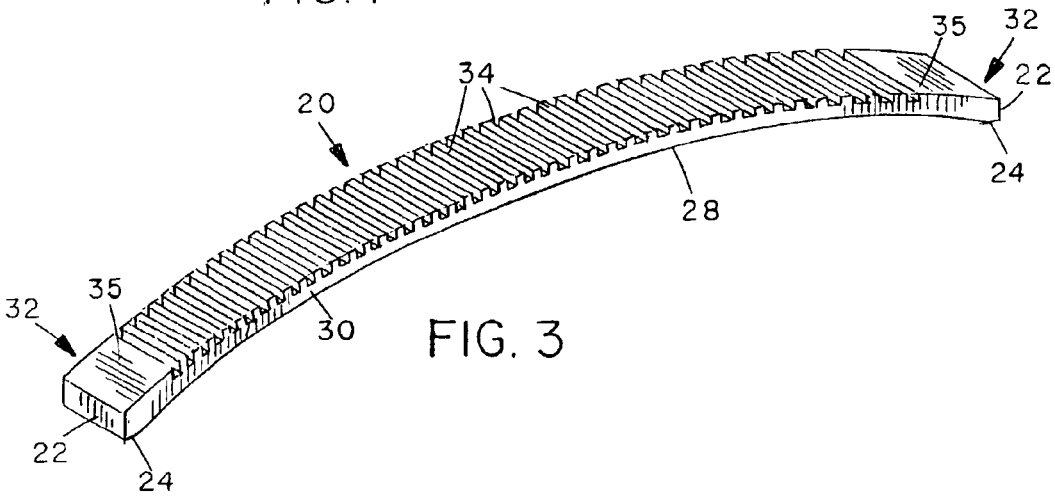
FIG. 3 is a perspective view of the entire arched jamb member of FIG. 2.

FIGS. 2 to 6 of the drawings illustrate an arched jamb member 20 according to an exemplary embodiment of the present invention, which is designed to replace the arched jamb member 12 of FIG. 1 as indicated in FIG. 2. The opposite ends of the jamb member 20 have angled cuts 22,24 equivalent to the cuts 15, 16 of the prior jamb member 12 so that they can mate with the cut-outs 14 at the upper ends of the upright jamb members 10. The opposite ends of jamb member 20 are secured in the respective cutouts 14 via fastener screws 25 or the like, as indicated in FIG. 2.

Jamb member 20 in the illustrated embodiment is formed of paint grade plastic material, but may alternatively be formed in wood, laminate, or composite material, or combinations thereof. Member 20 is of elongate, strip-like shape having upper and lower faces 26,28, opposite side edges 30, and opposite ends 32, and is molded to have a predetermined curvature. Arched jamb members 20 may be made in various different curvatures to form different arched wall openings.

The upper face 26 of jamb member 20 has a plurality of spaced, transverse cuts or kerfs forming spaced parallel ribs 34 extending between its opposite side edges 30, with the kerfs terminating short of opposite ends 32 of the member 20 to leave uncut end portions 35 for mounting in the opposite upright jamb members 10. The kerfs are of predetermined depth to leave a sufficient thickness 36 of material beneath the kerfs for nailing or attachment of a casing head or the like.

Figure 4:
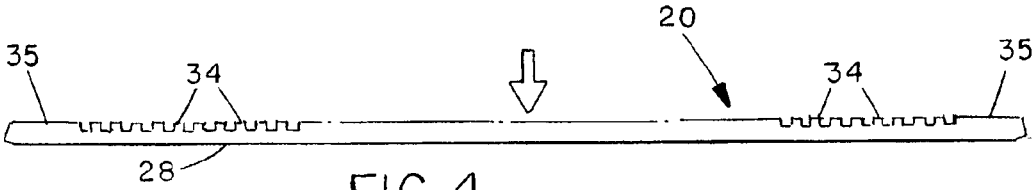
FIG. 4 is a side view of the arch member shown flattened for ease of storage and shipping.
Figure 5:
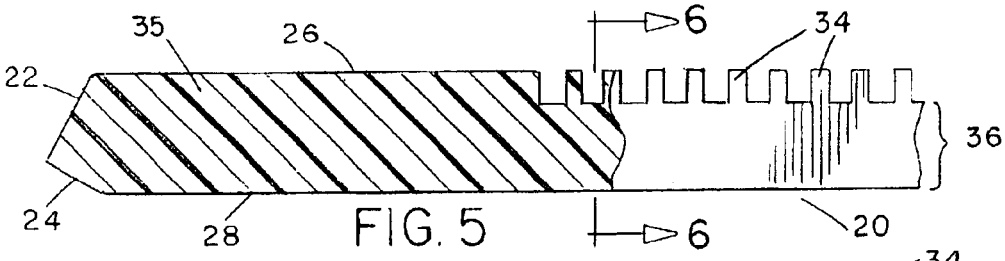
FIG. 5 is an enlarged side view of the arch member partially in section.
Figure 6:
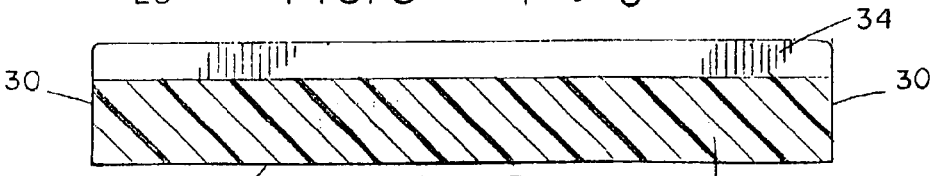
FIG. 6 is an enlarged sectional view taken on line 6—6 of FIG. 5.

The kerfs render the jamb member sufficiently flexible to enable it to be forced flat as indicated in FIG. 4, so that it may be packed into a flat container along with the upright jambs 12 and casing head (not illustrated). This avoids the need to ship the arched jamb member separately, which increases packaging and shipping costs. Once the package arrives at its destination and the parts are unpacked, the jamb member 20 will automatically spring back into an arched configuration, so that it is ready for immediate installation, when it can be adjusted by the installer as necessary to adopt the correct curvature.

Figure 7:
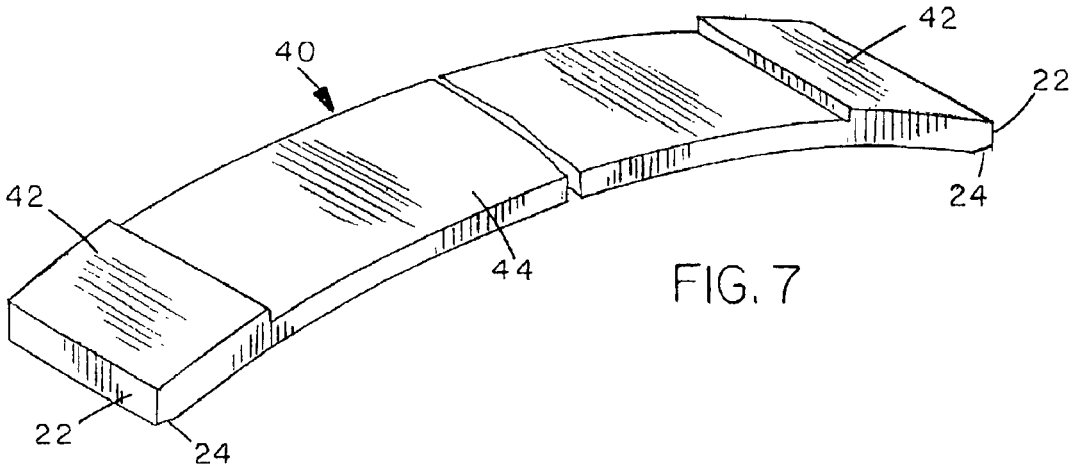
FIG. 7 is a perspective view of an alternative configuration of the arched jamb member.

FIG. 7 illustrates an arched jamb member 40 according to another embodiment of the invention, in which there are no kerfs as in the previous embodiment. Instead, jamb member 40 has thicker end portions 42 of similar shape and dimensions to the end portions 35 of the previous embodiment, and a downwardly recessed or indented region 44 of reduced thickness extending between the end portions 42. The reduced thickness of the jamb member 40 in the extended region 44 will provide sufficient flexibility for the member 40 to be forced flat for packaging purposes. At the same time, the member is pre-formed into the arched condition illustrated in FIG. 7, and will spring back into an arched form when released from its flat packaging.

Figure 8:
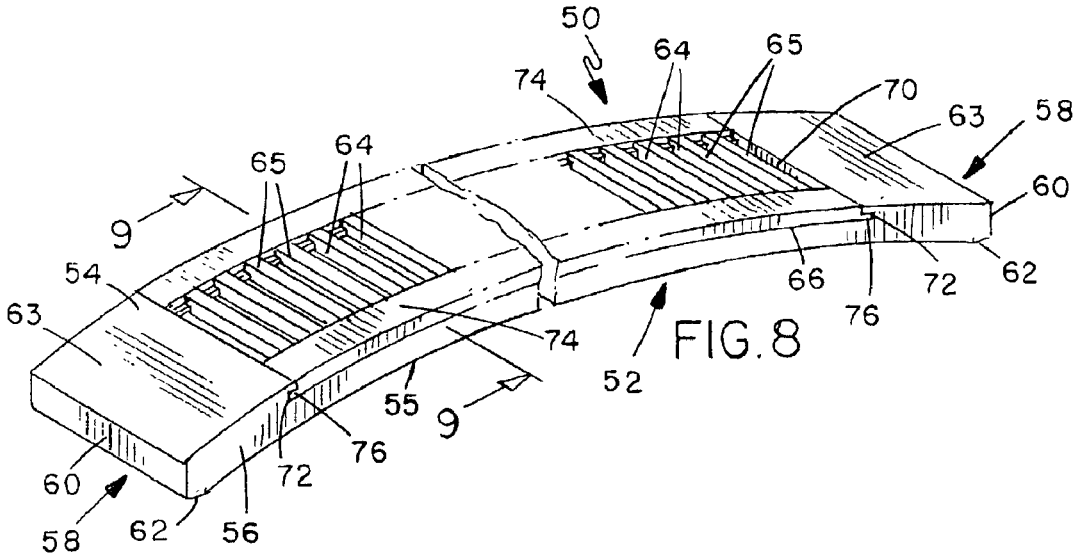
FIG. 8 is a perspective view of a further arched jamb member with side stiffeners.
Figure 9:
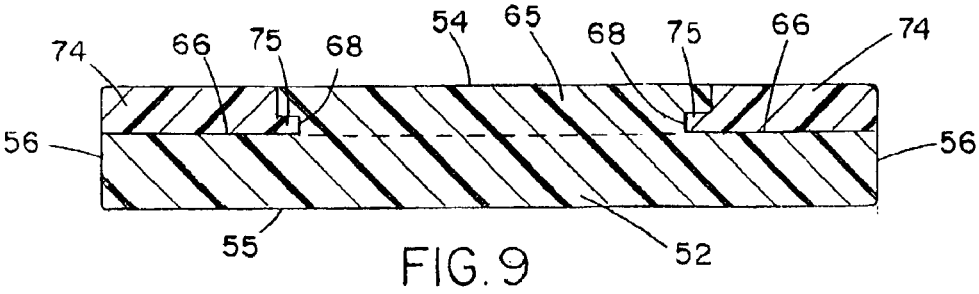
FIG. 9 is an enlarged sectional view taken on line 9—9 of FIG. 8.

FIGS. 8 and 9 illustrate a multi-part arched jamb 50 according to another embodiment of the invention, comprising a main jamb element or member 52 and a pair of stiffener strip members 74 which engage in indents 66 in opposite sides of the jamb member 52. As in the previous embodiments, the jamb element 52 is of elongate, strip-like shape, with upper and lower faces 54,55, opposite side edges 56, and opposite ends 58 which have angled cuts 60,62 for fitting into angled cut-outs 14 at the upper ends of the side jamb members 10. Element 52 has a pair of uninterrupted, full thickness end portions 63 and series of spaced transverse grooves or kerfs 64 defining upstanding spaced ribs 65 extending across a central portion of its width between the opposite end portions 63. Elongate cut outs or indents 66 extend inwardly from each side edge 56 of element 52 up to the ribs 65, with each rib 65 having an undercut portion 68 facing the respective indents 66. The indents 66 extend between the opposite end portions 63, and the end face 70 of each end portion which faces the kerfed central region and indents is also undercut to provide a slot or recess 72.

A pair of elongate, arcuate side strip members or elements 74 are designed for mating engagement in the respective indents 66. Each strip member 74 is of shape and dimensions substantially matching that of the indent 66, and has an outwardly projecting flange or rim 75 extending along one side edge, and outwardly projecting flanges or rims 76 extending from each end. When the member 74 is pushed transversely into indent 66, the rims 76 will engage under undercuts or recesses 72 at each end of the indent 66, while rim 75 engages under the undercut portions 68 of each rib.

Both the main element 52 and stiffener strip members 74 of the jamb 50 are pre-formed into a desired arched configuration. When both strip members 74 are engaged in the respective indents 66 as indicated in FIGS. 8 and 9, the overall arched jamb will be relatively stiff and not bendable. In order to permit the jamb to be packaged in a flat container, the side strip members 74 are simply pulled out of the respective indents. The main element 52 alone, without the side strip members, will be sufficiently flexible to permit it to be forced into a flat configuration, as was the case with jamb member 20 as illustrated in FIG. 4. Similarly, the side strip members 74 alone are flexible and can be forced flat. Thus, all three parts of the arched jamb member can be packaged in a single flat container, along with the other parts of the arched jamb assembly. Once the package arrives at its destination, the parts can be unpacked and will then spring back into an arched configuration. The side strip members will then be engaged in the indents 66 in order to increase the rigidity of the arched jamb member 50 and make it return to the correct curvature, making it easier to install while maintaining the correct curvature or arch.

In each of the above embodiments, the arched jamb member is preformed to have the correct curvature for defining an arched opening, yet can be packaged for storage and shipping in a flat rectangular container along with the other components of an arched jamb assembly. This will significantly reduce both storage and shipping costs. Additionally, although the arched jamb member is packaged in a flat condition, it will spring back automatically into an arched configuration when released from the package.

Although some exemplary embodiments of the invention have been described above by way of example only, it will be understood by those skilled in the field that modifications may be made to the disclosed embodiments without departing from the scope of the invention, which is defined by the appended claims.

I claim:

1. An arched jamb, comprising:

an elongate strip member having opposite upper and lower faces, opposite side edges, and opposite ends;

the strip member being formed into an arch of predetermined curvature; and the strip member being of sufficient flexibility to enable it to be forced into a substantially flat condition for shipping and storage purposes;

the upper face of the strip member being of predetermined width and having a row of parallel, transverse kerfs across at least part of the width of its upper face for providing sufficient flexibility to enable it to be forced into a substantially flat condition; and the kerfs being provided across a central region only of the upper face of the strip member, and an indented region of reduced thickness extends outwardly from the kerfs to each side edge.

2. The jamb as claimed in claim 1, including a pair of arcuate side members, each side member being of predetermined shape and dimensions for transverse sliding engagement in a respective indented region along one side of the row of kerfs.

3. The jamb as claimed in claim 2, wherein a plurality of upstanding ribs are defined between adjacent kerfs, the ribs having opposite ends facing the respective indented regions, each rib end having a recess, and each side strip having an inner side edge having an outwardly projecting flange for engagement in said rib end recesses to retain the side strip in the indented region.

4. The jamb as claimed in claim 3, wherein the strip member has end portions of predetermined dimensions which have no kerfs, the kerfs and indented side regions extending between said end portions, each end portion having an inner end face with an undercut recess facing the respective indented side regions, and each side strip having outwardly projecting flanges at each end for engagement in said undercut recesses in said end portions to retain the side strip in the indented region.

5. An arched jamb assembly, comprising:

an elongate strip member having opposite upper and lower faces, opposite side edges, and opposite ends;

the strip member being formed into an arch of predetermined curvature; and the strip member being of sufficient flexibility to enable it to be forced into a substantially flat condition for shipping and storage purposes;

a pair of upright jamb members, each jamb member having an upper end and an angled cut at its upper end; and the strip member having angled cuts at its opposite ends for mating engagement in the angled cuts at the upper ends of the upright jamb members in forming an arched wall opening.

6. The jamb as claimed in claim 5, wherein the strip member is of plastic material pre-formed into an arched shape.

7. The jamb as claimed in claim 5, wherein the upper face of the strip member is of predetermined width and has a row of parallel, transverse kerfs across at least part of the width of its upper face for providing sufficient flexibility to enable it to be forced into a flat condition.

8. The jamb as claimed in claim 7, wherein the strip member has end portions of predetermined dimensions which have no kerfs, the row of kerfs extending between the end portions.

9. The jamb as claimed in claim 7, wherein the kerfs extend across the entire width of the upper face of the strip member.

10. The jamb as claimed in claim 5, wherein the strip member has end portions of predetermined thickness and a central region of reduced thickness extending between the end portions, the reduced thickness region being sufficiently flexible to allow it to be forced flat.

11. An arched jamb, comprising:

an elongate strip member having opposite upper and lower faces, opposite side edges, and opposite ends;

the strip member being formed into an arch of predetermined curvature; and the strip member being of sufficient flexibility to enable it to be forced into a substantially flat condition for shipping and storage purposes;

the upper face of the strip member being of predetermined width and having a row of parallel, transverse kerfs across at least part of the width of its upper face for providing sufficient flexibility to enable it to be forced into a substantially flat condition;

the opposite side edges of the strip member each having an outwardly facing indented region extending at least along the row of kerfs; and a pair of arcuate side members, each side member being of predetermined shape and dimensions for transverse sliding engagement in a respective indented region along a respective side of the row of kerfs.

* * * * *